US006170401B1

(12) United States Patent
Miller et al.

(10) Patent No.: US 6,170,401 B1
(45) Date of Patent: Jan. 9, 2001

(54) RAIL VEHICLE FOR USE IN THE COLLECTION AND DISTRIBUTION OF RAILROAD CROSSTIES

(75) Inventors: Robert Miller, Columbia; Anthony Delucia, Gaston, both of SC (US)

(73) Assignee: Harsco Technologies Corporation, Fairmont, MN (US)

( * ) Notice: Under 35 U.S.C. 154(b), the term of this patent shall be extended for 0 days.

(21) Appl. No.: 09/072,586

(22) Filed: May 4, 1998

Related U.S. Application Data

(60) Provisional application No. 60/045,528, filed on May 5, 1997, now abandoned.

(51) Int. Cl.[7] ..... E01B 29/06
(52) U.S. Cl. ..... 104/9; 104/6; 104/12
(58) Field of Search ..... 104/2, 6, 9, 11, 104/12

(56) References Cited

U.S. PATENT DOCUMENTS 4,253,398 * 3/1981 Theurer et al. ..... 104/2
4,884,509 * 12/1989 Theurer et al. ..... 104/9
5,048,424 * 9/1991 Madison et al. ..... 104/9
5,154,124 10/1992 Madison .
5,186,109 2/1993 Madison .

* cited by examiner

*Primary Examiner*—S. Joseph Morano
*Assistant Examiner*—Robert J. McCarry, Jr.
(74) *Attorney, Agent, or Firm*—David C. Jenkins; Eckert Seamans Cherin & Mellott, LLC

(57) ABSTRACT

A railway maintenance vehicle exchanges worn crossties for new ones. Worn ties are collected and placed on an increased capacity storage car which permits ties to be placed atop the storage cars in a lateral orientation. New ties are simultaneously unloaded from the storage cars for distribution along the track. Tie transport and loading vehicles such as a gantry crane travel on rails atop the storage cars to move worn and new ties between a tie pick up car and a tie distribution car which has a tie ejector for laterally propelling ties fed to it on a queuing conveyor. The tie ejector has an endless drive chain with two striker plates attached at opposite ends and opposite sides such that they cannot interfere. The outward and downward trajectory of ejected ties is adjustable by a movable deflector shield. The tie ejector can be manually actuated by an operator while the maintenance vehicle is advanced, to drop ties next to the track at a predetermined and repeatable position relative to passing empty tie cribs.

10 Claims, 10 Drawing Sheets

RAIL VEHICLE FOR USE IN THE COLLECTION AND DISTRIBUTION OF RAILROAD CROSSTIES

CROSS REFERENCE TO RELATED APPLICATIONS

This application claims priority from U.S. Provisional application Ser. No. 60/045,528, filed on May 5, 1997 and now abandoned.

BACKGROUND OF THE INVENTION

1. Field of the Invention

The invention generally relates to a rail vehicle and method for the installation and removal of railroad crossties or sleepers. A tie exchanging apparatus extracts and loads old ties, and unloads and installs new ties. The apparatus comprises at least one tie distribution car, a tie collection car and an increased capacity storage car, each having interconnected guide rails bridging between cars, permitting tie loading and transport vehicles to move from car to car. The tie loading and transport vehicles transfer old ties to the storage cars from a location where the old ties are being removed from underneath the rails. At the same time, new ties are transferred from the storage cars to a location where a tie ejection apparatus places them along the rails for installation.

2. Prior Art

Railways comprise a bed of ballast material such as size four stones, in which ties are partly embedded to support rails attached to the ties at a specific gauge width, elevation and the like. The rails rest on tie plates and the rails and tie plates are fastened to the ties by spikes, bolts, clips or similar fasteners. In the United States, most rail ties are made of wood, which helps to absorb shock as trains pass. Concrete ties can also be used. Over time and with traffic, compressive and shearing forces damage the ties and loosen the fasteners. Ties also deteriorate due to weather. As a result, it is necessary to replace the ties as a matter of regular track maintenance.

Typically, ties are selected for replacement and preliminarily marked. The selected ties are disengaged from the rails by removing their fasteners, for example by pulling their spikes, and are pulled laterally from under the rails. A new tie is inserted. Tie plates, spikes and anchors are installed to couple the rail to the tie. The ballast is then rearranged by tamping and vibratory stabilization, often accompanied by realignment and elevational adjustments to the track. A selection of ties can be replaced, or all the ties can be replaced, in which case the tracks are lifted and rethreaded onto the new ties.

Railway ties are usually replaced using a number of special purpose rail cars that service a section of track while traveling over that section. Specialized rail cars may have one or more of spike pullers, tie extractors and inserters, tampers, stabilizers, etc., for serving the successive steps, including transporting new ties to the site and removing the old ties that have been extracted. It is efficient to use the same tie storage cars to bring new ties and to take away worn ties, namely by moving collected old ties to a location in the tie storage car from which new ties were previously unloaded, in a continuous operation. To accomplish this, in addition to having cars with storage space for ties, a track maintenance apparatus can include various transport conveyors, tie removal devices and cranes for manipulating the ties.

An example of a rail based tie exchange system is disclosed in commonly owned PCT Application No. PCT/US97/23156. A tie transfer rail vehicle exchanges old ties for new ties and comprises a plurality of gondola type cars with closed sidewalls and open tops. The tie exchanging operation commences with ties being drawn out from beneath the rails and placed on the rails for pick up by a tie pick-up device which can place the ties on a conveyor leading to an accumulating location. The tie pick-up car alternatively can have a collection cage at the front at track level, to pick up extracted ties left on the rails. A conveyor transports the ties to a temporary collection area from which they can be loaded into a storage car.

The tie exchanging operation commences with the old or existing ties being drawn out from beneath the rails and placed on or alongside the rails for pick up by a tie pick-up device which can place the ties on a conveyor leading to an accumulating location. The old tie pick-up car alternatively can have a collection cage attached to its front at track level to pick up old ties lying on the rails. The old tie pick-up car has a conveyor which transports the tie to a temporary old tie collection area which is located on the old tie collection car.

A plurality of gondola storage cars hold new ties for distribution and collected old ties, space for storage of old ties being made available as new ties are unloaded and distributed. The storage cars can be coupled between a tie distribution car at the rear of the apparatus and the tie collection car at the front. Thus it is necessary for tie transport vehicles to shuttle back and forth between an old tie loading point and an available location for storage of used ties, and between available new ties and a tie distribution point. The positions at which used ties are stored and new ties are available varies as work progresses and the new ties in the gondola cars are gradually replaced with collected used ties. Typically these points move in one direction or the other between the front and rear of a number of successive gondola cars. The storage cars have guide rails along their tops, including telescoping hinged sections which bridge between successive cars, to allow at least one tie transport vehicle to travel along the length of the storage cars.

The transport vehicle or vehicles move the old ties from the temporary tie collection area to a storage car. The transport vehicle also loads and moves new ties from the storage cars to the tie distribution car where they are distributed along the rails for installation.

Although this rail based tie exchange system accomplishes tie removal and distribution in an integrated manner, it fails to efficiently store and distribute new ties along the rails. The gondola cars used for storage have closed sides which prevent or make difficult the storage of ties in a lateral orientation. Elongated ties, having larger than normal dimensions, will not fit between the walls of the storage car. Thus, the ties must be longitudinally oriented within the car which takes more space per tie limiting the amount of ties which can be stored within the car. Once the space for storing ties is exhausted the tie exchange vehicle must cease operation and return to a location where old ties can be unloaded and the supply of new ties replenished.

Tie distribution is accomplished by a ramped conveyor which sporadically and intermittently discards ties along the rails. The conveyor is unable to place ties along the rails in a precise manner. For example, the point at which a tie is discarded often does not correspond to the place where the tie will be inserted under the rails. This requires additional manipulation of the tie before it can be inserted under the rails. Namely, the tie must be picked up and moved to the point along the rails where it is inserted, slowing the tie replacement operation.

Accordingly, it would be advantageous to provide a rail based tie exchange vehicle and a method of exchanging ties which optimizes and increases storage space and efficiently distributes ties along a railway for installation.

SUMMARY OF THE INVENTION

It is an object of the invention to provide a railway maintenance vehicle which travels along a track and efficiently transports, stores and distributes railroad ties.

It is a further object of the invention to provide a vehicle which integrates steps involved in tie removal and the distribution of new ties.

It is still a further object of the invention to provide an apparatus which quickly and precisely places new ties along the rails for installation.

It is yet another object of the invention to permit various types of tie loading and transport vehicles to move on guide rails atop the pick up storage and tie distribution cars.

These and other objects are accomplished by a tie transfer rail vehicle which exchanges old ties for new ties and comprises a plurality of cars, preferably including at least one increased capacity tie storage car and a tie distribution car which features a tie ejection apparatus for distributing ties along the rails. The tie exchanging operation commences with the old or existing ties being drawn out from beneath the rails and placed on the rails for pick up by an old tie pick-up device which can place the ties on a conveyor leading to an accumulating location. The old tie pick-up car alternatively can have a collection cage attached to its front at track level to pick up old ties lying on the rails. The old tie pick-up car has a conveyor which transports the tie to a temporary old tie collection area which is located on the old tie collection car.

The increased capacity tie storage car is structured to maximize the storage capacity of a rail based tie carrying track maintenance vehicle. A set of wheeled rail carriages is coupled by frame members extending longitudinally between the carriages, with a clear distance being defined between laterally opposite side frames at least as great as a length of ties to be carried by the car. Thus ties can be placed on the car laterally between the side frames. A movable underbody frame in the car is carried at least partly below the lowermost working level, which can be the upper supporting level of the rail carriages such that when lowered the underbody frame occupies a space longitudinally between the wheels. The underbody frame is movable upwardly and downwardly, causing ties stored in the movable storage area to be lifted to the lowermost working height of the tie handling crane. The ties can be laterally oriented in the underbody frame as well as between the side frames. The underbody frame can be liftable to a rest position using the crane, or can be independently powered. When the car is fully loaded, the ties in the underbody frame form the surface supporting the ties between the side frames. In this manner, substantially all the available volume occupied by the car, but for the rail carriages and frame members, carries ties that are accessible to the tie handling crane.

A set of guide rails are mounted to the top of the side frames of the car permitting a gantry crane or tie transport and loading vehicle to travel along the rails and remove ties from the top of the storage car and thereafter from the bins. The guide rails run along the length of the tie exchange vehicle and include telescoping hinged sections which bridge between successive cars to allow the gantry crane or tie transport and loading vehicles to travel along the length of the tie exchange vehicle.

The car as described has certain advantages resembling those of a flat car and other advantages more characteristic of a gondola car. The layers of stacked ties in the underbody frame partly and temporarily forming a flat deck surface for supporting the ties at and above the lowermost working height of the gantry crane. At the same time, the side frames form a rail support for the crane atop the car. And the stacking arrangement utilizes the area both above and below the supporting deck. As compared to a comparable flat car, storage capacity can be increased, for example, to permit storage and transport of an extra 248 ties having a dimensions of 5"×7"×9'.

The distribution of ties along the rails commences with the gantry crane loading ties and transporting them to a tie distribution car, located at the end of the tie exchange rail vehicle. The gantry crane first removes the ties stacked atop the storage bins. After these ties are removed, the underbody frame of the storage car is elevated to the lowermost working level where the gantry crane removes ties. Once unloaded onto the tie distribution car, a conveyor transports the ties to end of the tie distribution car.

The tie ejection apparatus is mounted on the trailing end of the tie distribution car. The tie ejection apparatus has an endless drive chain mounted to a frame by rotatably driven spaced sprockets such that the drive chain is bi-directionally movable along the periphery of the frame. A motor is coupled to one of the sprockets for selectively activating the drive chain. First and second striker plates are mounted to the drive chain and are spaced from one another by a distance greater than the distance between the sprockets. As a result, the striker plates are always on opposite sides of the frame and it is not possible for a striker plate to interfere with a tie being moved by the other. Preferably, the striker plates are placed to reside on opposite ends and on opposite sides of the frame and move around the ends.

Each striker plate can be responsible for pushing a tie in a specified direction, i.e. to the right or left, off of the tie distribution car, depending upon the direction in which the drive chain is rotated. Alternatively, the striker plates can be used alternately to discharge ties in the same direction by continuing to rotate the chain in the same direction.

A set of adjustable shields are mounted to opposite sides of the top of the frame. Each shield extends downwardly from the frame into the path of ties ejected on the respective side, and acts as a bumper for deflecting the tie as it is ejected. The shields repeatably control the position of the ties along the rails by controlling the trajectory of each tie's flight from the apparatus.

Other objects, advantages and features of the invention will become apparent from the following detailed description of the invention when considered in conjunction with the accompanying drawings.

BRIEF DESCRIPTION OF THE DRAWINGS

There are shown in the drawings embodiments of the invention as presently preferred. It should be understood, however, that the invention is not limited to precise arrangements and instrumentalities shown as examples.

DETAILED DESCRIPTION OF THE PREFERRED EMBODIMENTS

Figure 1:
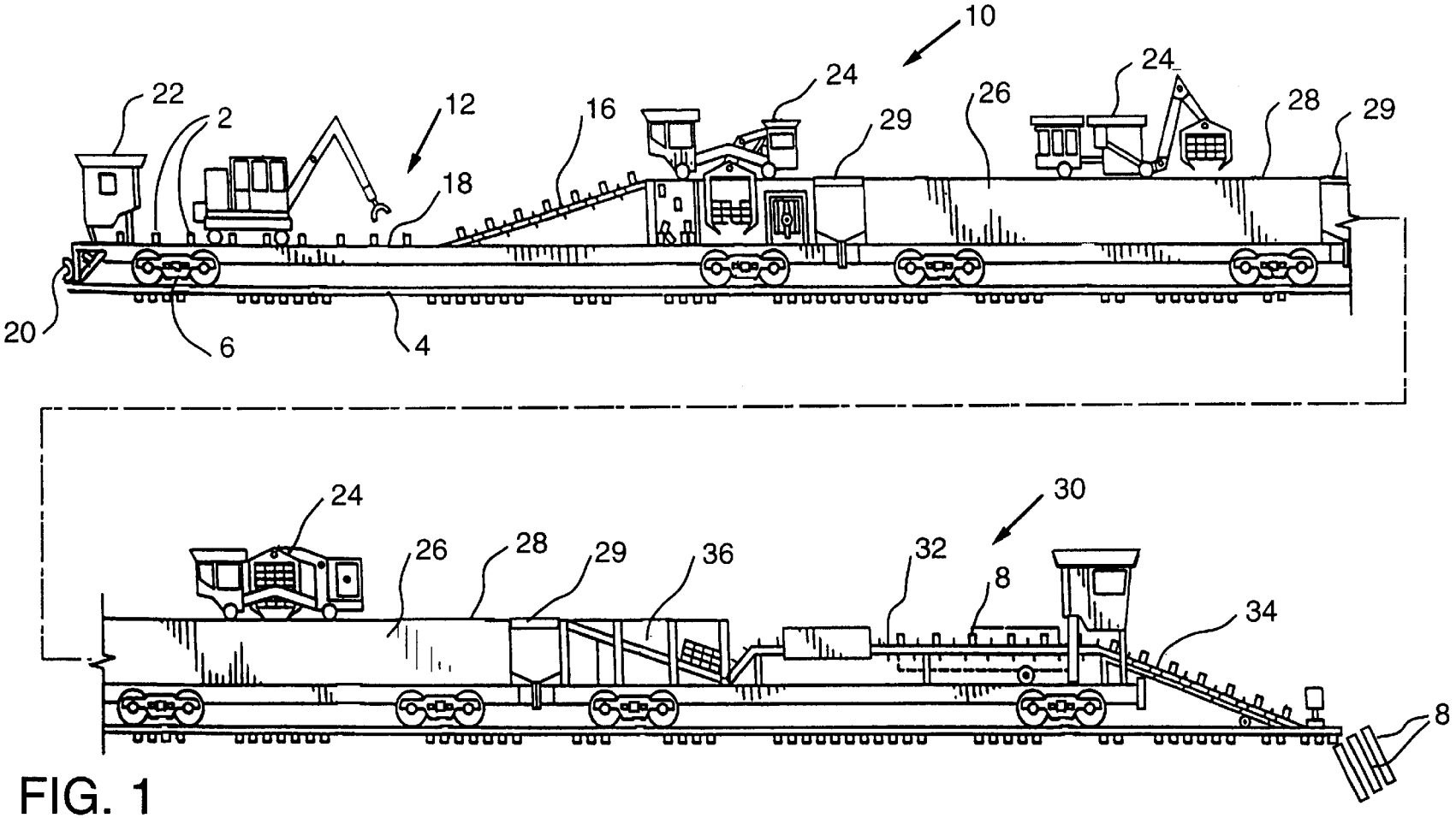
FIG. 1 is a side elevational view of a tie exchanging vehicle which includes gondola type storage cars and a conveyor to distribute ties along the rails.
Figure 1A:
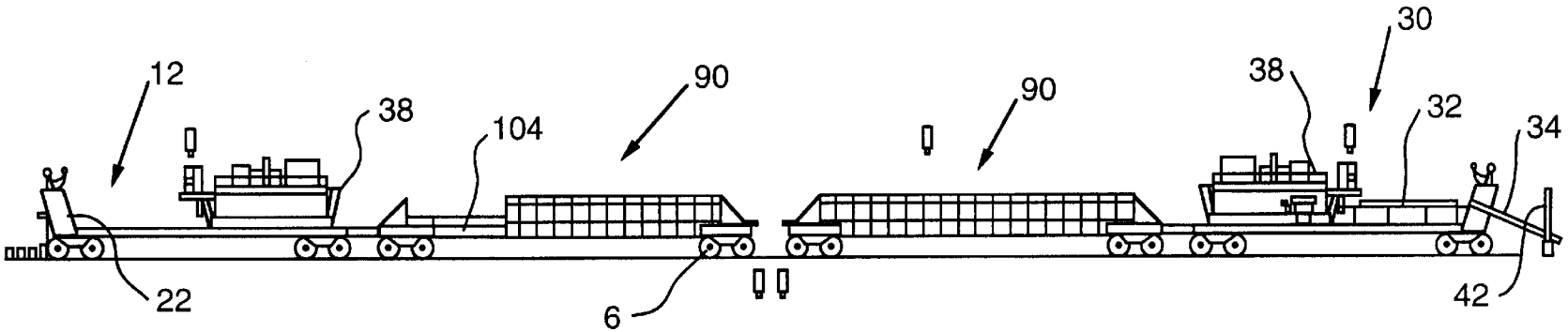
FIG. 1A is a side elevational view of a tie exchange vehicle which includes increased capacity storage cars and the tie ejection apparatus.

In the drawings, the same reference numbers are used throughout to identify corresponding elements. FIG. 1 shows a typical tie exchange vehicle 10 for the removal of worn ties 2 and the distribution of new ties 8. The vehicle 10 comprises a leading tie pick-up car 12, a plurality of gondola cars 26, and a trailing new tie distribution car 30. Tie pick-up car 12, gondola cars 26, and new tie distribution car 30 as shown are supported on standard rail undercarriages 6. In the alternative, one or more of cars 12, 26 and 30 could be road vehicles which are adapted for rail travel by railway guide wheel devices, such as the type disclosed in U.S. Pat. Nos. 5,186,109 and 5,154,124.

New tie distribution car 30 is coupled to storage cars 26 which are likewise coupled to tie pick-up car 12 at the front of vehicle 10. Tie pick-up car 12 is shown in greater detail in FIG. 2. Tie pick-up car 12 can be self propelled to provide the motive force for moving vehicle 10, or the vehicle can be drawn by a locomotive. Tie pick up car 12 moves along the rails in the direction indicated by arrow 3, in which the old ties 2 and new ties 8 are to be exchanged. Old tie pick-up car 12 includes an operator's cab 22 where the operator controls the various devices located on old tie pick-up car 12, including power to move vehicle 10.

Figure 2:
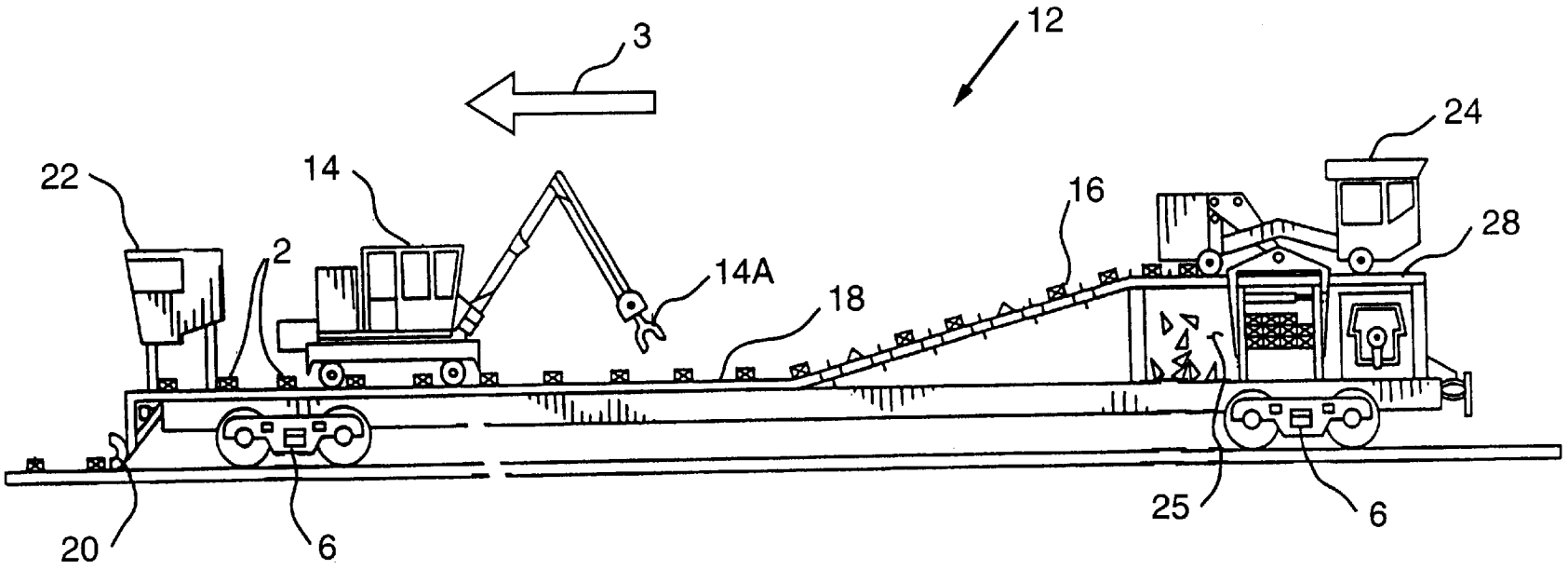
FIG. 2 is a side elevational view of a tie pick up car of the tie exchange vehicle.

In the embodiment shown in FIGS. 1–2, a tie collection cage 20 is mounted to the front of tie pick-up car 12. The tie collection cage 20 scoops up the old ties 2, which are left lying on the rails 4 by a preceding tie extraction apparatus (not shown), as the vehicle 10 travels along the rails 4. Conveyor belts 18 and 16 transport collected old ties 2 upwardly and rearwardly from collection cage 20 to drop into a temporary receiving area 25, where the old ties are accumulated. Tie collection cage 20 can comprise a tie pickup mechanism of the type shown in U.S. Pat. No. 5,197,389, the disclosure of which is hereby incorporated. In such a device, a tie clamp engages the old ties 2 which are then elevated to the level of conveyor belt 18.

Tie collection cage 20 can only capture ties 2 readily if left across the tops of rails 4. A tie crane 14 is disposed on old tie pick-up car 12 and picks-up ties located on the field sides of rails 4 or otherwise inaccessible to collection cage 20. Ties also often fracture during removal, and tie crane 14 can handle relatively small pieces. For this purpose, tie crane 14 includes a gripping device 14A at the end of a crane arm, which is mounted on a rotatable chassis for accessing an area along the sides of the track. Tie crane 14 is supported on flanged wheels that straddle conveyor belt 18 providing clearance for ties 2 on conveyor 18 to pass beneath crane 14. Crane 14 also can be moved longitudinally along the front of tie pick-up car 12. When a tie 2 or piece of a tie is picked up from the side of the track, crane 14 places it on conveyor 18.

The rear section of pickup car 12 includes a temporary tie storage area 25 in which ties from inclined conveyor 16 are accumulated in a generally parallel group. A set of guide rails 28 are provided along the top of the rear of tie pick up car 12 on either side of temporary storage area 25 and extend continuously rearward along the tops of the gondola cars 26. Tie transport and loading vehicles or gantry cranes 38 travel along guide rails 28, to remove accumulated ties from storage area 25 and transport them to an old tie storage location, for example in one of cars 26. Guide rails 28 start at car 12 and extend along the top of storage cars 26 to new tie distribution car 30 at the far end of vehicle 10.

Gondola cars 26 store old ties 2 after they are removed from the rails 4 and store new ties 8 for distribution along the rails 4. All the cars can be loaded initially with new ties, leaving only a small space for initial collection of worn ties. As new ties are unloaded, their space is available for old ties to be stored. Preferably cars 26 for storage of old ties are located immediately behind old tie pick-up car 12 while storage cars 26 holding new ties are located nearer to tie distribution car 30. As maintenance vehicle 10 moves along, old and new ties are moved rearwardly by tie transport cars that shuttle back and forth between the pickup or distribution cars 12, 30, and respective locations where old ties are stored or new ties unloaded. Generally, old ties are stored first in the front tie storage cars and new ties are unloaded first from the front-most part of the new tie supply. The line between old and new ties moves backward over time.

The tie storage cars shown in FIG. 1 are gondola type rail cars 26. As the space available on the gondola cars 26 becomes exhausted, it is necessary for the vehicle 10 to return to a base of operation to discharge the old ties and replenish the supply of new ties. Thus, it is crucial to optimize the use of storage space on the vehicle 10. The most desirable and easiest method of optimizing storage space is to laterally orient ties within the gondola cars 26. However, the gondola cars 26 have sidewalls which only permit ties of certain dimensions to be laterally oriented. Thus, longer ties must be longitudinally oriented within the gondola cars 26. Longitudinally orienting the ties within the gondola cars 26 reduces the amount of ties which can be stored therein.

Figure 13:
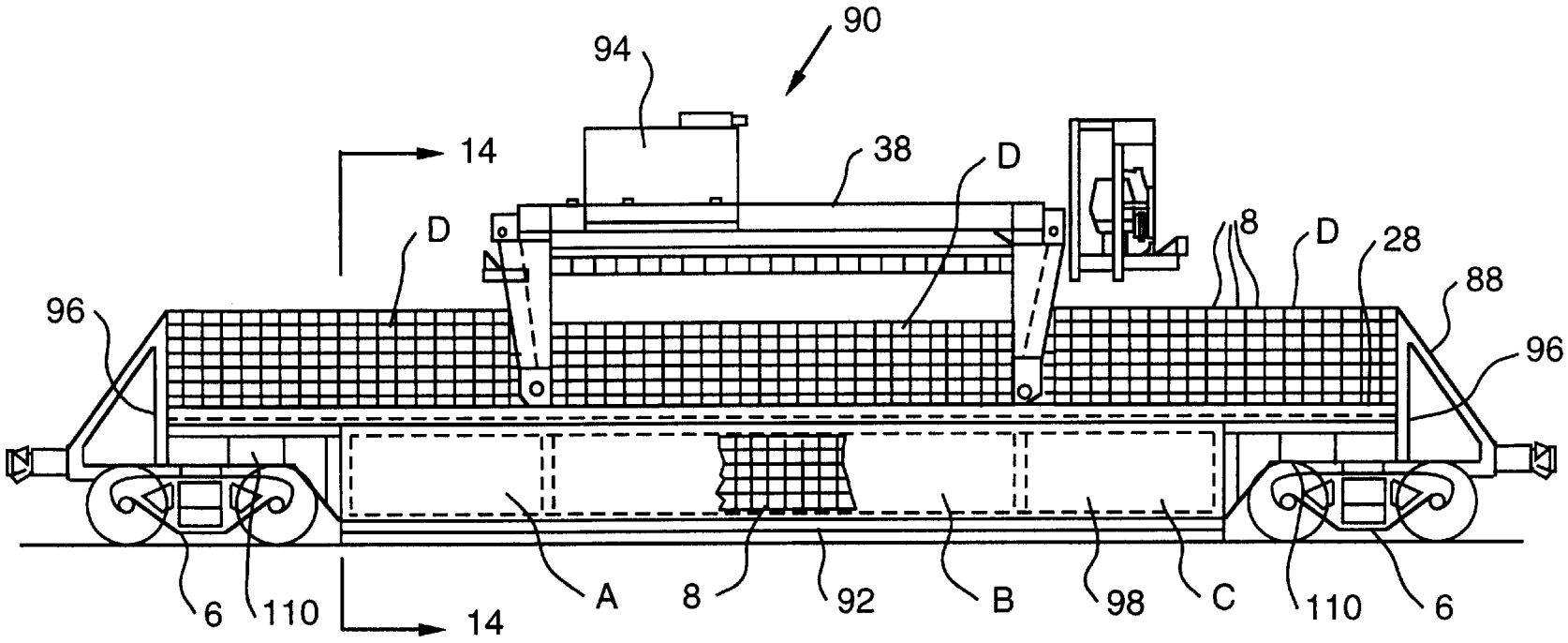
FIG. 13 is a side elevational view of an increased capacity tie storage car.
Figure 14:
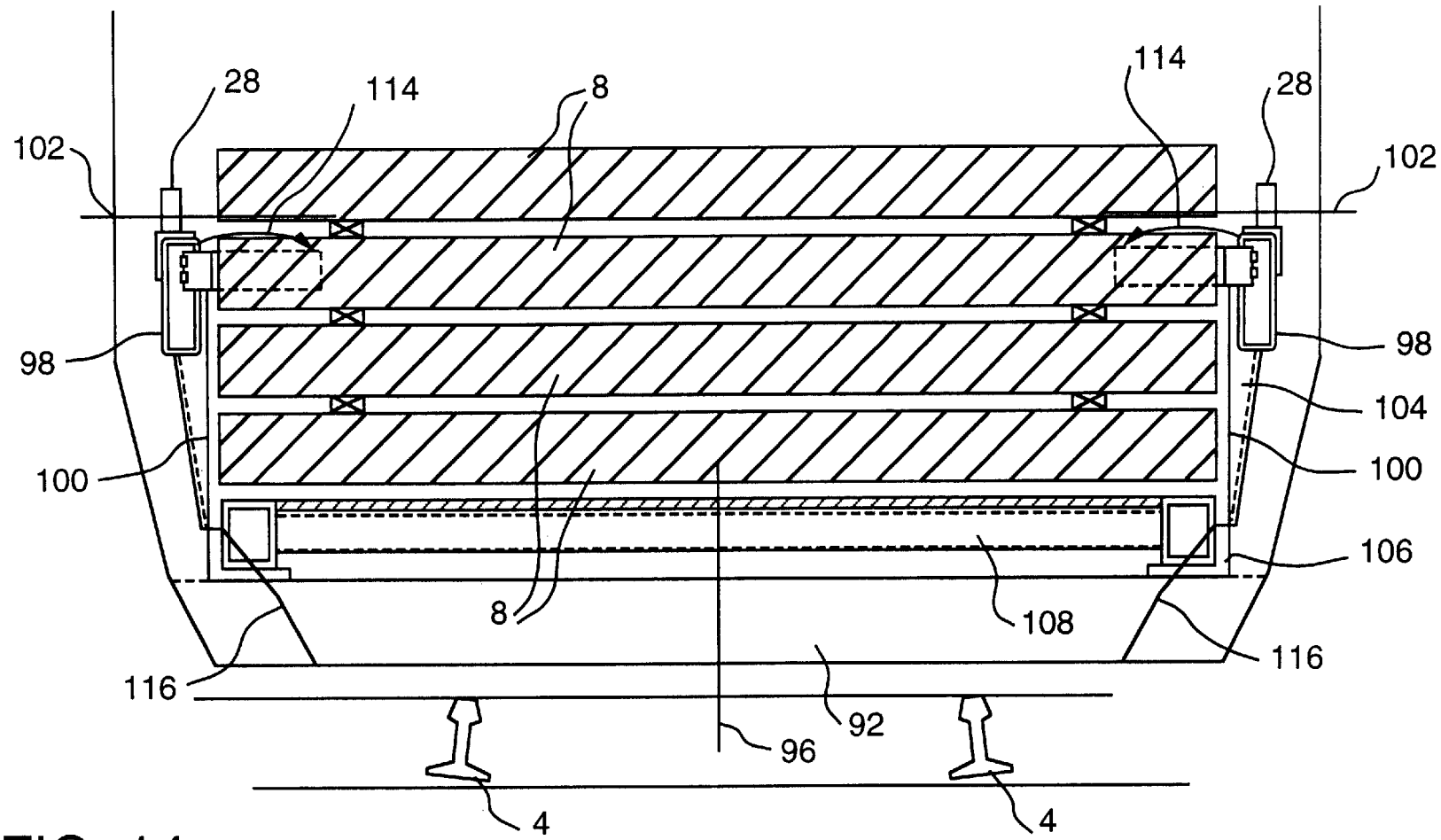
FIG. 14 is a view taken along line 14—14 of FIG. 13.

FIGS. 13 and 14 show an increased capacity tie storage car 90 which replaces the gondola cars 26 of the tie exchange vehicle 10. The car 90 generally has a car body 88 mounted on a set of wheeled rail carriages 6 coupled by side frame members 98 extending longitudinally between the carriages 6. The frame members 98 are spaced apart so that the area between them defines a storage area 104 which is clear for receiving stacked ties. A clear distance is defined between the innermost laterally opposite frame members that form side frames 98. The clear distance is at least as great as a length of ties to be carried by the car, for example being ten feet wide for receiving nine foot ties. Thus the ties can be placed on the car 90 laterally between the side frames 98.

A crane 38 is mounted on the frame members 98 and carries a tie handling crane 38 having a reach sufficient to access all the storage area 104 of the car 90 between the frame members 98 at least down to a lowermost working level of the crane 38, indicated by arrow 96. In the embodiment shown, the crane 38 is supported on guide rails 28 which allow the crane 38 to be longitudinally movable atop the car 90. The tie handling crane 38 thus has sufficient vertical reach to access ties stored below it down to the lowermost working level, and is movable forward and aft to reach the ties.

According to an inventive aspect, the car body 88 is further defined by frame an underbody frame 92 positioned at least partly below the lowermost working level. The underbody frame 92 forms the bottom of the tie storage area 104 and is movable upwardly and downwardly such that ties stored in the storage area 104 can be lifted up, at least to the deck level, indicated by line 96, which is the lowermost working level of the tie handling crane 38. The underbody frame 92 preferably also has a width at least as great as the length of ties to be stored in the car 90. Thus the ties stored in the storage area 104 can also be oriented laterally. In its lowered position and when fully loaded with stacked ties 8, the underbody frame 92 positions the ties 8 such that the upper surface of the top row of ties in the underbody frame 92 is substantially parallel with the lowermost working level 96. The top layer of ties 8 stacked on frame 92 defines a platform on which additional layers D can be stacked and supported from that level upwardly. Therefore, the entire inner volume of the car can be entirely filled with stacked ties.

A powered apparatus such as a hydraulic, pneumatic or other lifting mechanism 110 is mounted to the car body 88 for selectively positioning the underbody frame 92 at either its lowered level as described above, or at a raised point at which the lowest ties in the underbody frame 92 have been lifted until their undersides are located at the lowermost working level 96, or optionally at intermediate heights between these two positions. Alternatively, the crane 38 can be employed to lift the underbody frame 92. Inasmuch as the crane 38 must release its engagement with the underbody frame 92 to manipulate ties 8, a temporary holding structure such as hinged supports 112 is employed if the crane 38 is used to lift the underbody frame 92. The supports 112 are hinged to side frames 98 and are longitudinally aligned with frames 98 when the underbody frame 92 is in its lowermost position. When frame 92 is elevated to the lower working level 34, the supports 110 are swung outward in the direction of arrow 114, as shown in phantom in FIG. 14, and underbody frame 92 is lowered onto supports 110.

Yet another alternative is for a spring loaded pawl and a ratchet or similar latching means to be provided on the underbody frame 92 and fixed portions of the side frames 98 (or vice versa) such that the underbody frame 92 is liftable and when released held temporarily in position. Preferably the pawl mechanism is located at a position where the crane 38 can engage and retract the pawl when lifting or lowering the underbody frame 92.

In the embodiments shown, the underbody frame comprises a plurality of separately movable tie storage bins A, B, and C three being shown in FIG. 13. It is possible to employ one movable bin or several, and whether one or more bins is used may turn on the crane 38 or other lifting mechanism's ability to readily handle the weight of a single large bin versus the inconvenience of having plural bins that must be raised individually.

As shown in FIG. 13, the tie handling crane 38 preferably comprises a gantry crane. The gantry crane 38 straddles over the load and is carried by rails 28 that are disposed lower than the top of the ties 8, for example substantially at the lowermost working level 96. The lowermost working level 96 is substantially level with an upper supporting surface of the rail carriage housings 116 at either end of the car 90, and accordingly the car 90 has the benefits of a conventional flat-type rail storage car plus the additional capacity of the storage area 104 defined by the underbody frame 92 and side frames 98, which additional capacity would otherwise be an empty space under a conventional flat-type car between the rail carriages 6.

With reference to FIG. 14 and the more specific aspects of the preferred embodiment, the underbody or recessed storage area 104 includes a set of mounting seats 106 attached to underbody frame 92. A set of at least three movable storage bins A, B and C each comprise a set of side walls 100 and a bottom wall 108. The three bins A, B and C are placed in the recessed storage area 104 so that the bottom wall 108 rests on mounting seats 106 and the side walls 100 abut the side frames 98. Ties are stacked in lateral orientation in bins A, B and C until the ties 8 are substantially parallel with the lowermost working level 96. Additional layers D of ties (see also FIG. 13) are stacked atop the ties in the bins A, B and C, also in lateral alignment. However, ties 8 in either the bins A, B, C or the upper layers C could also be stacked in a longitudinal alignment if desired.

In the embodiment shown, the additional storage area afforded by recessed storage area 104 results in a substantial increase in the storage capacity of car 90. For example, assuming that the ties 8 to be stored have nominal dimensions of 5 inches high by 7 inches wide by 9 feet long, the area above the lowermost working level 96 typically can accommodate ties six rows high up to the level of the fore and aft bulkheads and 78 columns between the bulkheads, or 468 ties. Stacking the ties 8 higher than the bulkheads could interfere with the clearances needed by the gantry crane 38 or similar loading/unloading device, as further described below.

By stacking ties below the lowermost working level 96, an additional capacity of 248 ties can be stored. This is accomplished without adversely affecting loading and transport of the ties 8, because the ties 8 can be brought from the recessed storage area 104 into a position where they can be accessed by the crane 38. Thus in this embodiment the invention increases the capacity of the car by about 53%.

The guide rails 28 for the crane 38 are mounted to the top of the side frames 98, as shown in FIG. 13. The guide rails 28 permit the gantry crane 38, or alternatively a different type of tie transport and loading vehicle such as one having a boom and jaw, as shown in FIG. 1, to travel along the rails 28 and remove ties 8 from the top of storage car 90.

A gantry crane 38 as shown can engage around a number of ties and exert sufficient inward pressure to handle a large section of ties in a single operation, such as 25 ties as shown in FIG. 13. The gantry crane 38 can be propelled by providing motive force to its rail wheels or by a winch and cable system which pulls the crane 38 along rails 28.

The tie loading operation commences with the rail anchors being separated from the old ties 2 that are to be replaced. The ballast can be cleared to more readily grasp the tie ends, or the worn ties 2 can be simply grasped and pulled lengthwise from underneath the rails 4. The removed ties 2 are placed atop or aside rails 4 to be picked up. As shown in FIGS. 1 and 2, the old tie collection car 12 is located at the front of vehicle 10. The old ties 2 have previously been removed from underneath rails 4 and are awaiting pick-up. Old tie pick-up car 12 pulls vehicle 10 along rails 4 so that cage 20 captures old ties 2. Crane 14 picks up any ties 2 which are fractured or otherwise unable to be captured by cage 20. After the ties 2 are picked up, they are transported by conveyors 18 and 16 to temporary tie storage area 25. Tie transport and loading vehicle 24 or alternatively gantry crane 38, as shown in FIG. 15, positions itself over the tie collection area 25 and loads old ties 2 and transports them to a tie storage car 90.

Figure 3:
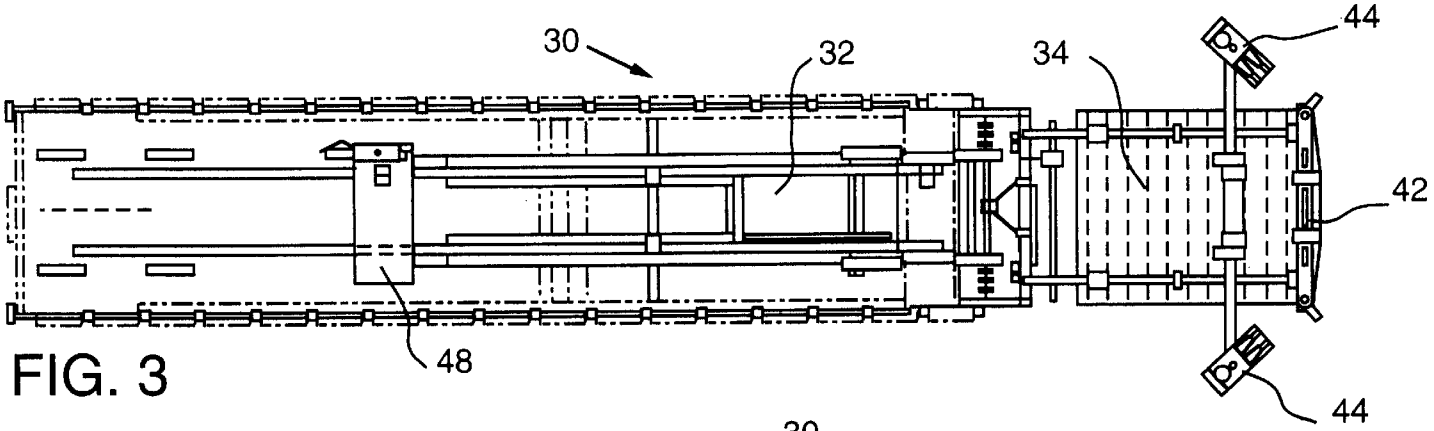
FIG. 3 is an overhead vies of a tie distribution car of the tie exchange vehicle.

Cars 90 store new ties 8 for distribution along the rails 4. The new tie distribution car 30 is located at the rear of the tie exchange vehicle 10, attached to cars 90. As shown in FIGS. 3 and 13, a gantry crane 38 loads ties from a car 90 transports them and unloads the them onto new tie distribution car 30. New tie distribution car 30, shown in FIGS. 3–7, includes a flat conveyor 32 and a retractable ramp conveyor 34 which are rotated by motor 48. The conveyors 32 and 34 space ties 8 and move them to a tie ejection apparatus 42 which is mounted to the end of retractable conveyor 34.

Figure 6:
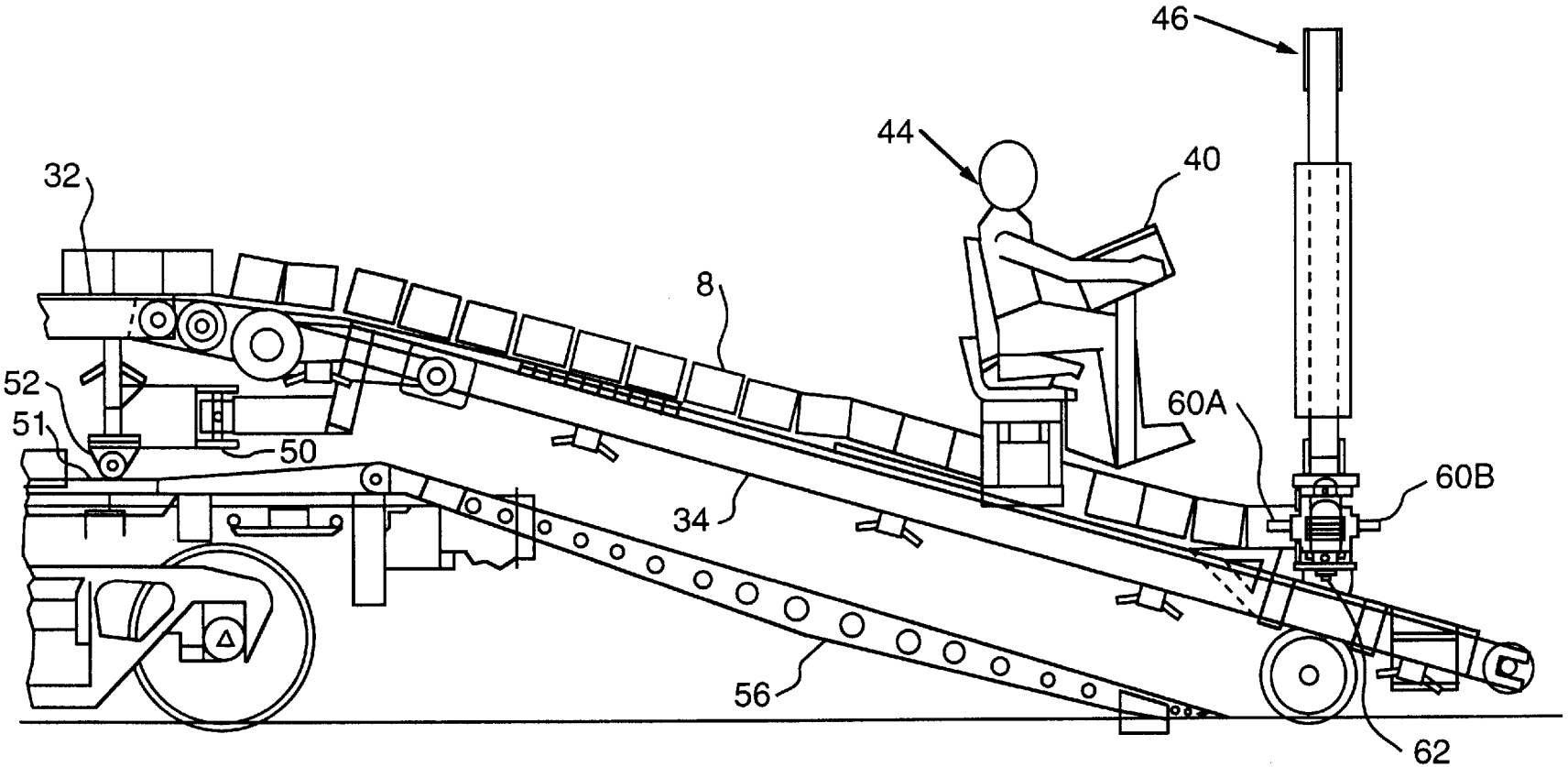
FIG. 6 is a side elevational view of rear of the tie distribution car.
Figure 7:
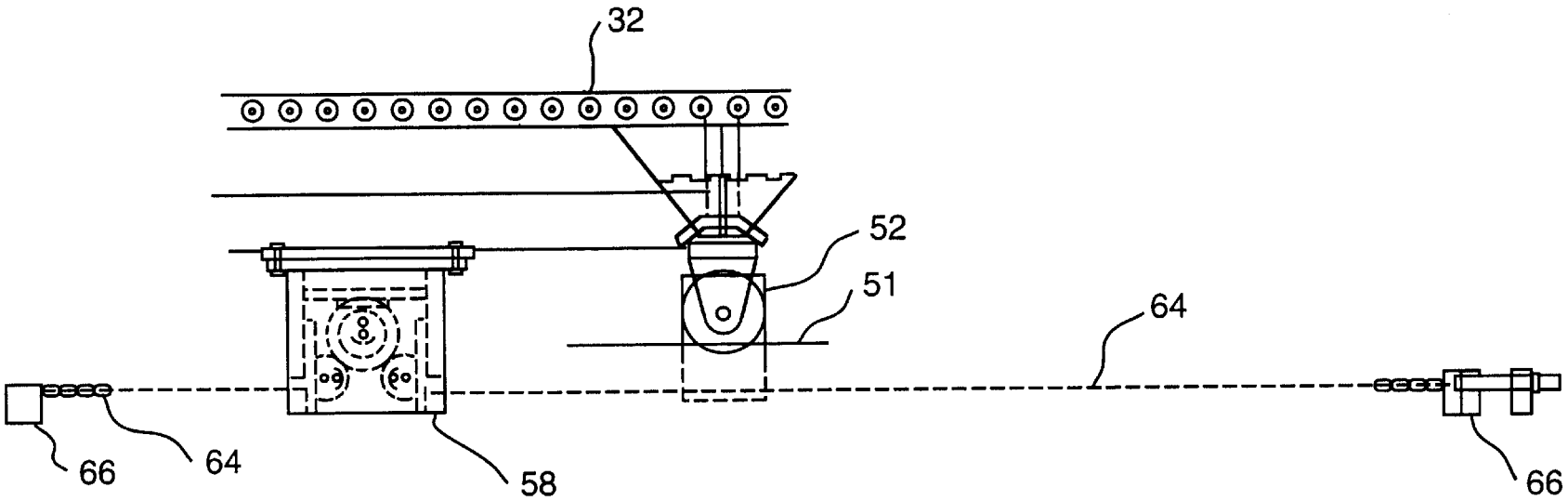
FIG. 7 is a pictorial view of the ramp extraction assembly.
Figure 8:
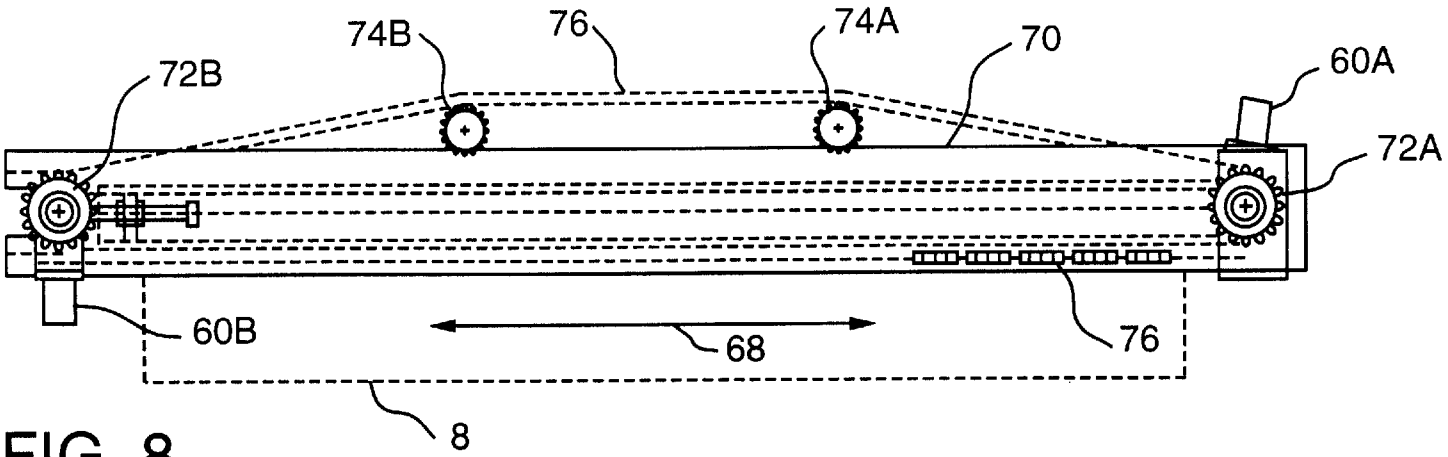
FIG. 8 is an overhead view of the tie ejection apparatus.
Figure 9:
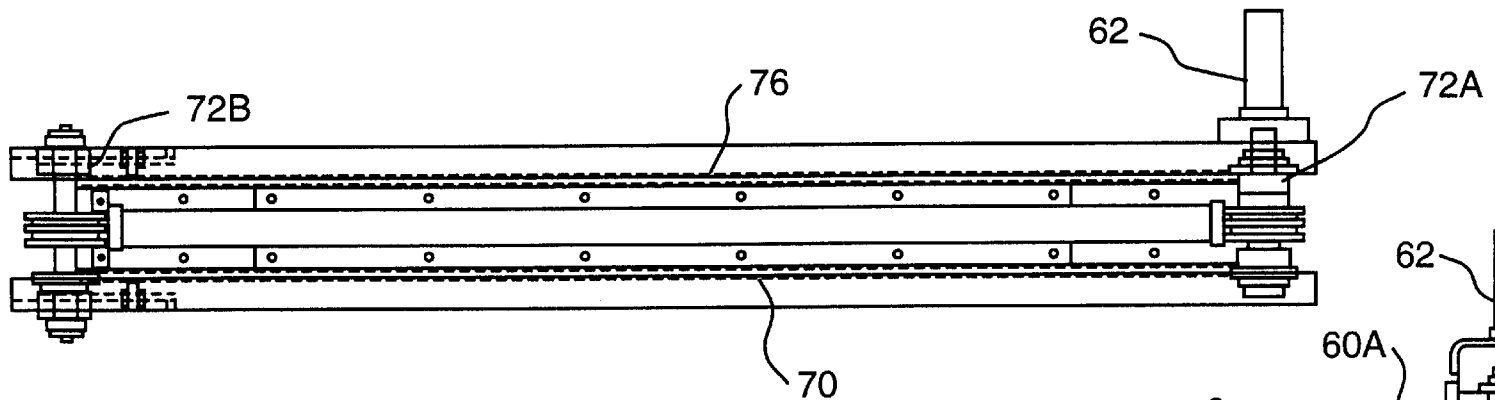
FIG. 9 is a front elevational view of the tie ejection apparatus.
Figure 9A:
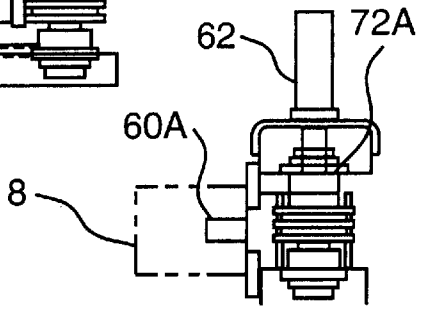
FIG. 9A is a side elevational view of the tie ejection apparatus.

Vehicle 10 must travel to the point along the rail line where ties are to be exchanged. During travel of vehicle 10, it is desirable to retract conveyor 34 onto the top of car 90. Conveyor 32 is mounted to the top of vehicle 90 by a series of rollers 52 and is linked to conveyor 34 by ramp retraction linkage 50, shown in detail in FIG. 5. A reversible hydraulic motor 58, shown in FIG. 7, is mounted to the bottom of conveyor 32. An elongated chain 66 is anchored to opposite ends of the tie distribution car 90. Chain 66 is linked to motor 58 by a gear assembly (not shown) so that as motor 58 is actuated the ramp 34 is pulled along chain 66. Ramped conveyor 34 is supported at its lower end by rail wheels 54. When it is desired to retract or lower ramp conveyor 34, a set of retractable rails 56, shown in FIG. 6, are lowered from the back of tie distribution car 90. As motor 58 is actuated conveyor 32 pulls ramped conveyor 34, via linkage 50, upwards or pushes ramp conveyor 34 downwards along rails 56 depending upon the direction in which the reversible hydraulic motor and is actuated.

Figure 4:
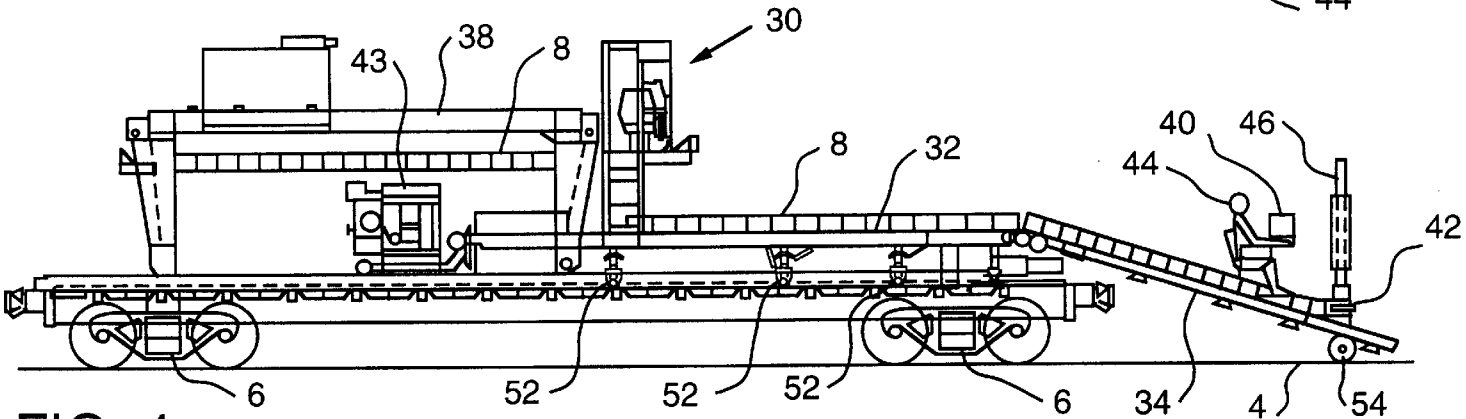
FIG. 4 is a side elevational view of a tie distribution car of the tie exchange vehicle.
Figure 5:
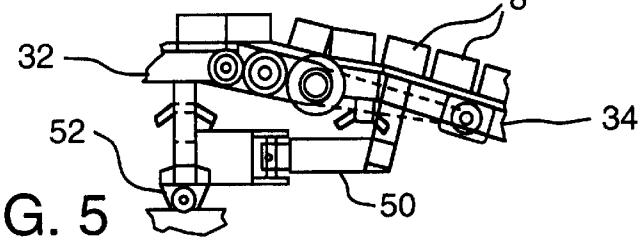
FIG. 5 is side elevational view showing further details of FIG. 4.

A conventional tie exchange apparatus, as shown in FIG. 1, relies on the ramped conveyor 34 to distributed new ties 12 onto the rails 3. Conveyor 34 places ties along the rails 4 in an intermittent and sporadic manner. Thus, the point at which a new ties 8 is discarded may not correspond to the empty tie crib. This requires the new tie 12 to be picked up and moved to the empty tie crib slowing the tie insertion operation. The tie ejection apparatus 46 ensures the precise placement of a tie 8 along the rails 4. Tie ejection apparatus 46, as shown in FIGS. 3 and 4, is mounted to the end of ramped conveyor 34 at the end of tie distribution car 30. The tie ejection apparatus 46 receives a tie 8 and pushes or ejects it off of ramp 34 at the point where the tie 8 is to be placed under the rails. The ramped conveyor 34 feeds ties 8 into the ejector apparatus 46 on a one-by-one basis. When a tie contacts the apparatus 46, the conveyors 32 and 34 are switched off. After the tie 8 is ejected, the conveyors 32 and 34 are switched on whereupon another tie is fed into the tie ejection apparatus 46.

The tie ejection apparatus 46 is described in detail with reference to FIGS. 8–12. The tie ejection apparatus 46 comprises an endless drive chain 76 mounted to an elongated frame 70 by a plurality of rotatable sprockets 72A, 72B, 74A and 74B such that the drive chain 76 is rotatable along the periphery of frame 70. Sprockets 72A and 72B are mounted at opposite ends of frame 70. One or both of sprockets 72A and 72B are connected to a preferably-reversible drive motor 62 which rotates drive chain 76. Sprockets 74A and 74B are mounted to the back side of frame 70 and are adjustable in an outward direction to tension chain 76.

A first striker plate 60A and a second striker plate 60B are mounted to the drive chain 76 at opposite ends and opposite sides of the frame 70. Each striker plate 60A and 60B can be used to push tie 8 in a specified direction, i.e. to the right or left as indicated by arrow 68, laterally off of ramp 34 depending upon the direction in which the drive chain 76 is rotated. Alternatively, the chain drive can be rotated in one direction, and the striker plates used alternately to propel successive ties in one direction. As a further alternative, the belt can be reversed after a stroke to retract a striker plated to engage a next tie. These options are available to the operator.

In replacement of selected ties, the operator monitors the track for empty cribs and actuates the tie ejector to place a tie at each empty crib. If all the ties are being replaced, at least along a stretch of track, the operator can operate the ejector to eject ties at regular times or at regular spacing as the vehicle proceeds along the track.

Inasmuch as the striker plates are spaced to reside on opposite sides and opposite ends of the endless chain, when one is propelling a tie the other is always clear of the tie on the opposite side of the endless chain. Thus during ejection of tie 8, one of the striker plates, i.e. 60B, is on the front or tie side of frame 70 while the other striker plate 60A is at the rear or opposite side. The striker plate that is not active in ejecting the tie 8 cannot obstruct the movement of the tie 8.

Figure 12:
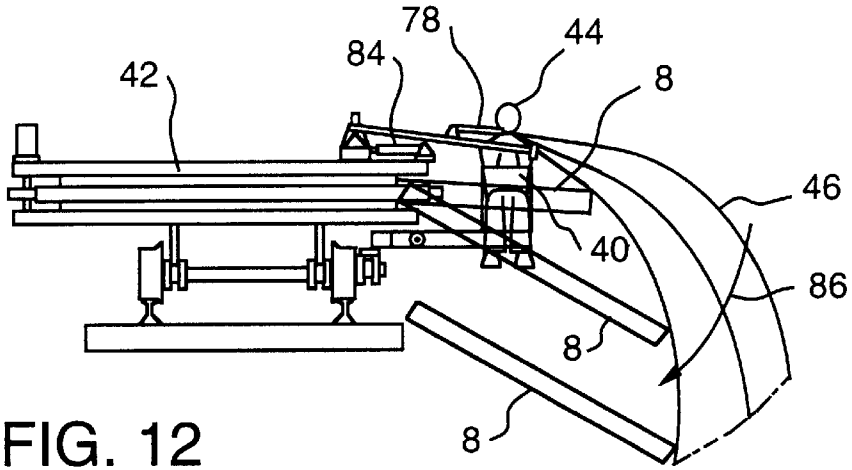
FIG. 12 is a rear elevational view showing the tie ejection apparatus mounted to the tie distribution car.
Figure 10:
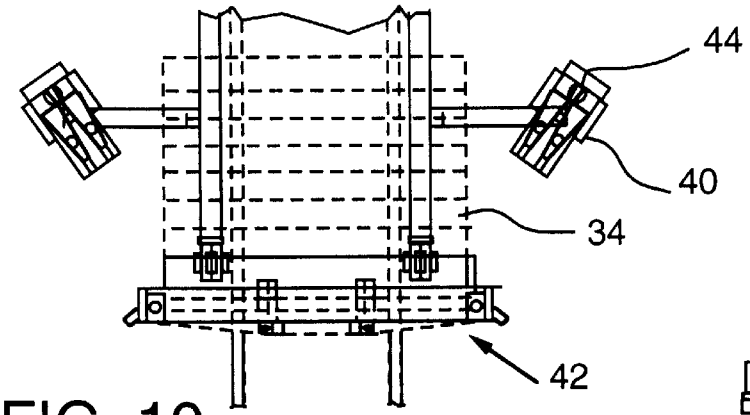
FIG. 10 is an overhead view showing the tie ejection apparatus mounted to the tie distribution car.
Figure 11:
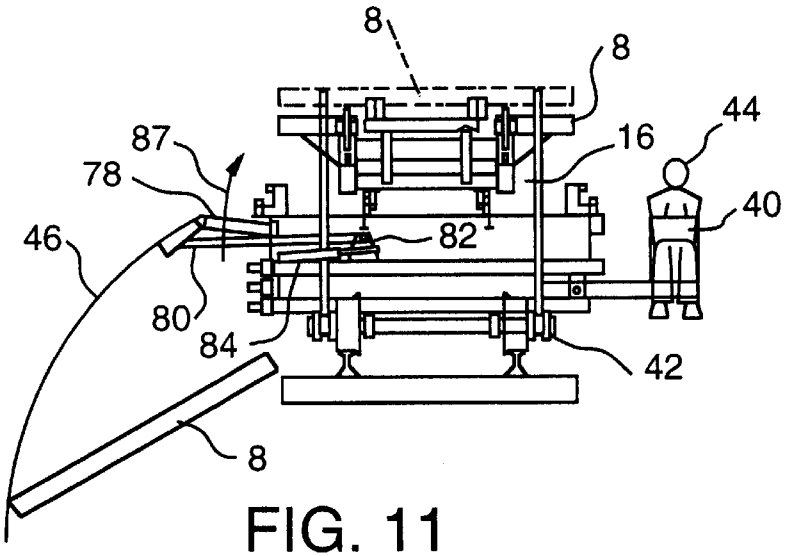
FIG. 11 is a rear elevational view showing the tie ejection apparatus mounted to the tie distribution car.

A set of adjustable shields 46 are mounted to opposite sides of the top of the frame 70. Each shield 46 extends downwardly from the frame and acts as a bumper for deflecting tie 8 as it is ejected, thus controlling the trajectory of the tie's flight and its placement along the rails 4. The angle at which the ties 8 are deflected by shields 46 is adjustable by changing the relative angle between shield 46 and the frame 70. This is accomplished by moving shield 46 in the direction indicated by arrow 86, as shown in FIG. 12. The shields 46 are mounted to frame 70 by an arm 80. Each shield is pivotally mounted to arm 80. A hydraulic cylinder 78 is interconnected between arm 80 and shield 46 such that actuation of the hydraulic cylinder moves the shield 46 in a downward direction indicated by arrow 86.

While the rail exchange vehicle 10 is traveling along rails 4, it may be necessary to retract the shields 46 to prevent contact with an obstruction. Arm 80 is mounted to frame 70 by a rocker linkage 82. A hydraulic cylinder 84 is interconnected between the rocker linkage and the arm 80. Cylinder 84 is actuated and the shield 46 is retracted upwards in the direction indicated by arrow 87.

In summary the tie distribution operation commences by lowering the ramped conveyor 34 from the top of tie distribution car 30. A loader vehicle 24 or a gantry crane 38 moves ties 8 and unloads them onto a tie distribution car 30. Ties are unloaded onto conveyor 32 which transports the ties rearward to tie ejection apparatus 42. An operator 44 controls the operation of the tie ejection apparatus 42 from control panel 40. The operator 44 lowers the shields 46 into position by operation of hydraulic cylinders 84. The operator 44 adjusts the angle of deflection for the ties by operation of hydraulic cylinder 78. As ties are ejected and/or as the topography varies further adjustment of the shields 46 can be effected to maintain proper repeatable placement of the ties 8 along the side of rails 4, preferably close beside empty tie cribs.

Once the shields 46 have been properly adjusted, the operator selects the side of the car 30 from which the tie 8 is to be ejected. The operator activates drive motor 62 causing the drive chain 76 to rotate in the desired direction. If a tie 8 is to be ejected to the right, the drive chain 76 is rotated counter-clockwise causing striker plate 60B to move along the front face of frame 70 where it pushes tie 8. The tie 8 is deflected downwardly by shield 46 so as to be directed into position along rails 4. A separate vehicle picks up tie 8 and places it in an empty tie crib, underneath the rails.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

I claim:

1. A railway vehicle for handling railway ties, comprising:

a first car having a tie ejection apparatus and a second car having at least one tie loading apparatus;

at least one storage car which stores ties in a lateral orientation relative to a direction of travel;

a guide track comprising guide rails mounted along and spanning between said first car, second car and storage car;

at least one of a tie loading and transport means which travels along said guide rails;

an elongated mounting frame having a front face and a rear face;

a drive chain mounted to the elongated frame by at least two sprockets so as to be rotatable relative to the elongated frame;

a first striker plate and a second striker plate mounted to the drive chain at opposite ends of the mounting frame so that the first and second striker plates are positioned on opposite sides of the frame; and means coupled to at least one of the sprockets for rotating the drive chain.

2. The railway vehicle of claim 1, wherein the elongated frame is mounted on a tie transport conveyor at a rear of the first car.

3. The railway vehicle of claim 2, wherein the tie transport conveyor places a long side of a rectangular tie in abutting contact with the front face of the mounting frame.

4. The railway vehicle of claim 3, wherein rotation of the drive means brings one of the striker plates to the rear face of the mounting frame, the other of the striker plates being thereby moved to the front face of the mounting frame, so as to contact a short side of an elongated railway tie and propel the tie laterally off the conveyor.

5. The railway vehicle of claim 1, wherein the drive means comprises a reversible hydraulic motor.

6. The railway vehicle of claim 1, further comprising a tie deflection shield protruding into a path of the tie, for altering a trajectory of the tie.

7. The railway vehicle of claim 6, wherein the deflection shield is mounted by an arm to the mounting frame, the tie deflection shield being hinged to the arm, and further comprising a hydraulic cylinder interconnected between the arm and the shield, whereby the cylinder is actuated to move the shield relative to the arms for setting a deflection angle.

8. The railway vehicle of claim 7, wherein the arm is hinged to the mounting frame and further comprising a hydraulic cylinder connected between the arm and the frame for retracting the deflection shield.

9. The railway vehicle of claim 1, wherein said tie loading apparatus comprises a tie collection cage located on the front of said second car at track level, said cage capturing previously extracted ties from the rails and transferring the extracted ties to a conveyor belt which moves the extracted ties from said cage to a tie collection area.

10. A method of exchanging worn ties with new ties using a rail carried railway maintenance vehicle with a plurality of tie storage cars having guide rails for supporting a plurality of tie loading and transport means for movement over the storage cars, comprising the steps of:

collecting worn ties at a first part of the vehicle and accumulating the worn ties at a collection point on the vehicle, using at least one of a tie collection basket, a conveyor, a crane and a movable tie extractor;

transporting the worn ties using one of the plurality of tie loading and transport means operating on the guide rail, and moving the worn ties from the collection point to a next available area of the tie storage cars, such that the worn ties are progressively stored at a longitudinally changing position in the storage cars;

simultaneously with said collecting and transporting of the worn ties using a one of the plurality of tie loading and transport means to load new ties from a supply of new ties in the storage cars, proceeding to remove the new ties progressively from a longitudinally changing position in the storage cars;

unloading the ties onto a tie distribution car and transporting the ties to the rear of the tie distribution car; and placing a tie in abutting contact with a tie ejection apparatus mounted to the rear of the tie distribution car and ejecting a tie along the side of the rails.

* * * * *